US005533579A

United States Patent [19]

Chu

[11] Patent Number: 5,533,579

[45] Date of Patent: Jul. 9, 1996

[54] SHOCK PREVENTIVE PNEUMATIC TOOL AS AUTOMATICALLY SHUT OFF UNDER NO LOAD CONDITION

[76] Inventor: Eric Chu, c/o Hung Hsing Patent Service Center, P.O. Box 55-1670, Taipei, Taiwan

[21] Appl. No.: 331,707

[22] Filed: Oct. 31, 1994

[51] Int. Cl.[6] ..... E21B 5/00

[52] U.S. Cl. ..... 173/17; 173/13; 173/212; 173/162.2

[58] Field of Search ..... 173/2, 4, 11, 13, 173/17, 18, 212, 162.1, 162.2, 210

[56] References Cited

U.S. PATENT DOCUMENTS

| | | | |
|---|---|---|---|
| 2,899,934 | 8/1959 | Salengro | 173/18 |
| 3,223,181 | 12/1965 | Price | 173/18 |
| 3,250,334 | 5/1966 | Sussman | 173/18 |
| 3,446,291 | 5/1969 | Judd et al. | 173/17 |
| 3,599,730 | 8/1971 | Luthman | 173/17 |
| 3,924,690 | 12/1975 | Shaw | 173/13 |

*Primary Examiner*—Scott A. Smith

[57] ABSTRACT

A pneumatic tool includes: a main cylinder having an operating lever for on-off control for the supply of compressed air into the pneumatic tool, a barrel member resiliently coupled to the main cylinder and having a tool unit secured at its front end portion, and an automatically closed throttle valve held in the main cylinder, whereby upon touching on a working object when starting the pounding job, the barrel member will be retracted to open the throttle valve for performing the pneumatic operation by the pneumatic tool; and when subjected to no load condition, the throttle valve will be restored and closed automatically to temporarily stop the pounding of the pneumatic tool to minimize vibration hazard, and an air cushion is inherently formed between the barrel member and the main cylinder for dampening or absorbing the vibration shock of the pneumatic tool.

5 Claims, 5 Drawing Sheets

SHOCK PREVENTIVE PNEUMATIC TOOL AS AUTOMATICALLY SHUT OFF UNDER NO LOAD CONDITION

BACKGROUND OF THE INVENTION

In operating a conventional pneumatic tool such as an air-operated hammer or chisel for breaking concrete, cutting stone, digging road surface or doing other percussion works, the tool unit held in the front end portion of a pneumatic tool will be actuated to percuss the working object as reciprocatively impacted by a piston reciprocatively driven in the barrel of a pneumatic tool. When piercing through a working object by the tool unit or when the tool unit is slipped from the working object, the shoulder of the tool unit may be relatively separated from the piston to cause an "empty percussion" of the piston, thereby increasing vibrational shock hazard and influencing occupational safety and health.

If the pneumatic tool is designed to automatically shut off its compressed air supply to temporarily stop the reciprocative movements when the tool is under no load (empty percussion) condition, the vibration hazard of the pneumatic tool will then be prevented or reduced, and the benefit of the occupational safety and health can then be obtained.

SUMMARY OF THE INVENTION

The object of the present invention is to provide a pneumatic tool including: a main cylinder having a grip portion secured thereon and an operating lever for on-off control for the supply of compressed air into the pneumatic tool, a barrel member resiliently coupled to the main cylinder, and an automatically closed throttle valve held in the main cylinder, whereby upon touching on a working object when starting the pounding or percussion job, the barrel member will be retracted to open the throttle valve for performing the pneumatic operation by the pneumatic tool; and when subjected to no load or empty percussion condition, the throttle valve will be restored automatically to shut off the air supply to temporarily stop the pounding operation of the pneumatic tool and minimize vibration hazard, and an air cushion is inherently formed between the barrel member and the main cylinder for dampening or absorbing the vibration shock of the pneumatic tool.

Another object of the present invention is to provide a pneumatic tool including a bushing member disposed around an air-operated tool unit held in a front portion of the barrel member of the pneumatic tool and normally urged forwardly by a bushing restoring spring retained in the front end portion of the barrel member to interrupt the inlet compressed air supply when the tool unit is under no load condition without touching a working object, and a piston having a plunger portion coupled with an impacting rod portion for impacting the tool unit and having a dampening oil filled in a socket in between the plunger portion and the impacting rod portion for dampening or absorbing the vibration shock caused by the impact between the piston and tool unit (the chisel).

Still another object of the present invention is to provide a heat-dissipating device among the relative moving parts for removing the operational frictional heat of the pneumatic tool.

DETAILED DESCRIPTION

Figure 1:
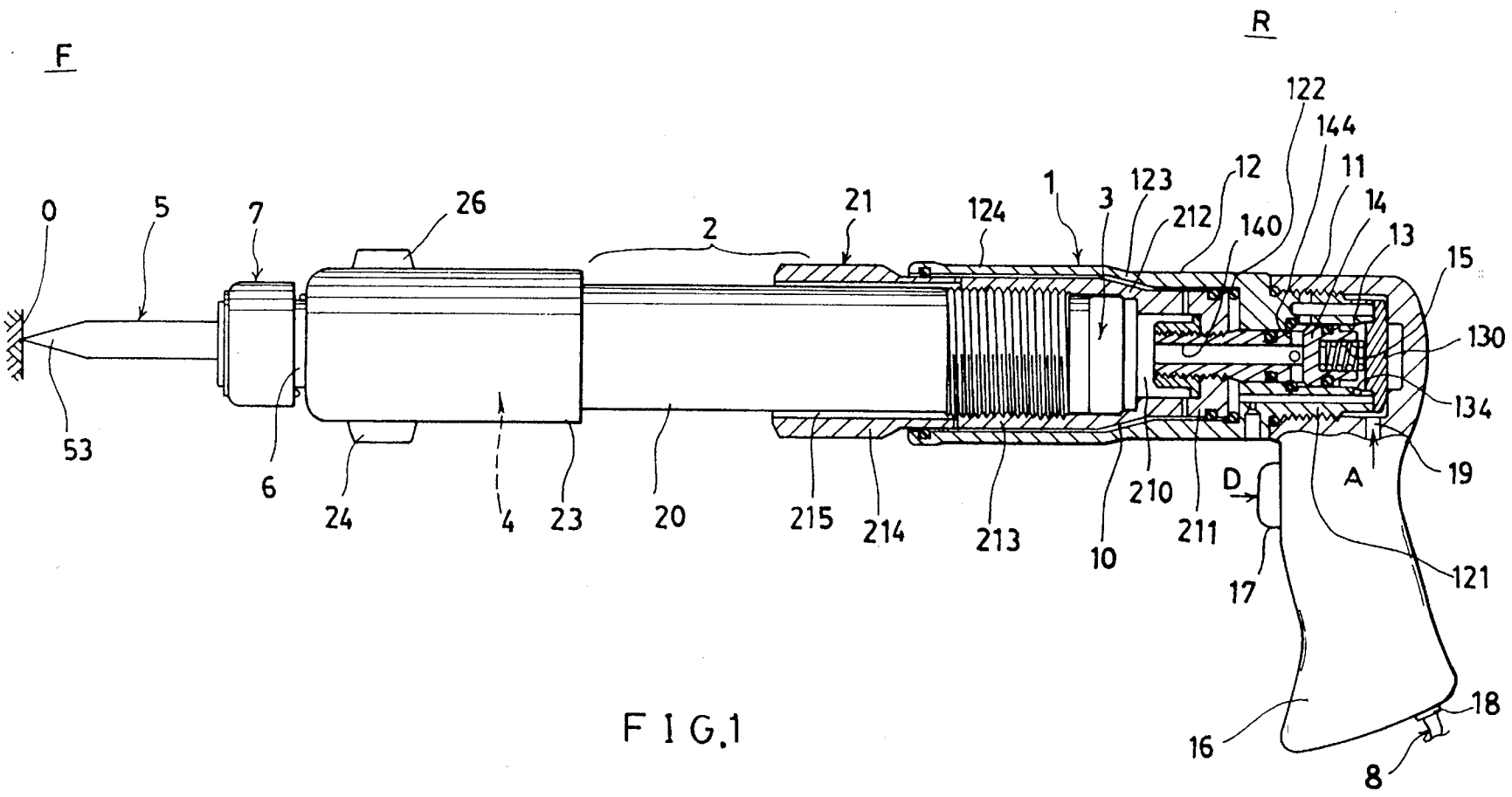
FIG. 1 is an illustration of the present invention having a rear portion being partially cut away.

As shown in FIGS. 1–7, the present invention comprises: a main cylinder 1 adjacent to a rear portion R of the pneumatic tool, a barrel member 2, an oscillating valve 3 formed on a rear end portion of the barrel member 2 for controlling a forth (F1) and back (B) streamflow of air for reciprocative movement of a piston means 4 reciprocatively movably held in the barrel member 2 for pounding a tool unit 5, which may be an air-operated chisel or hammer, mounted in a bushing member 6 movably held in the front end portion of the barrel member 2 by a tool connector 7 resiliently secured to the front end portion of the bushing member 6 adjacent to the front portion F of the pneumatic tool, and a compressed air hose 8 for directing a compressed air supply source (not shown) into the pneumatic tool of the present invention.

Figure 2:
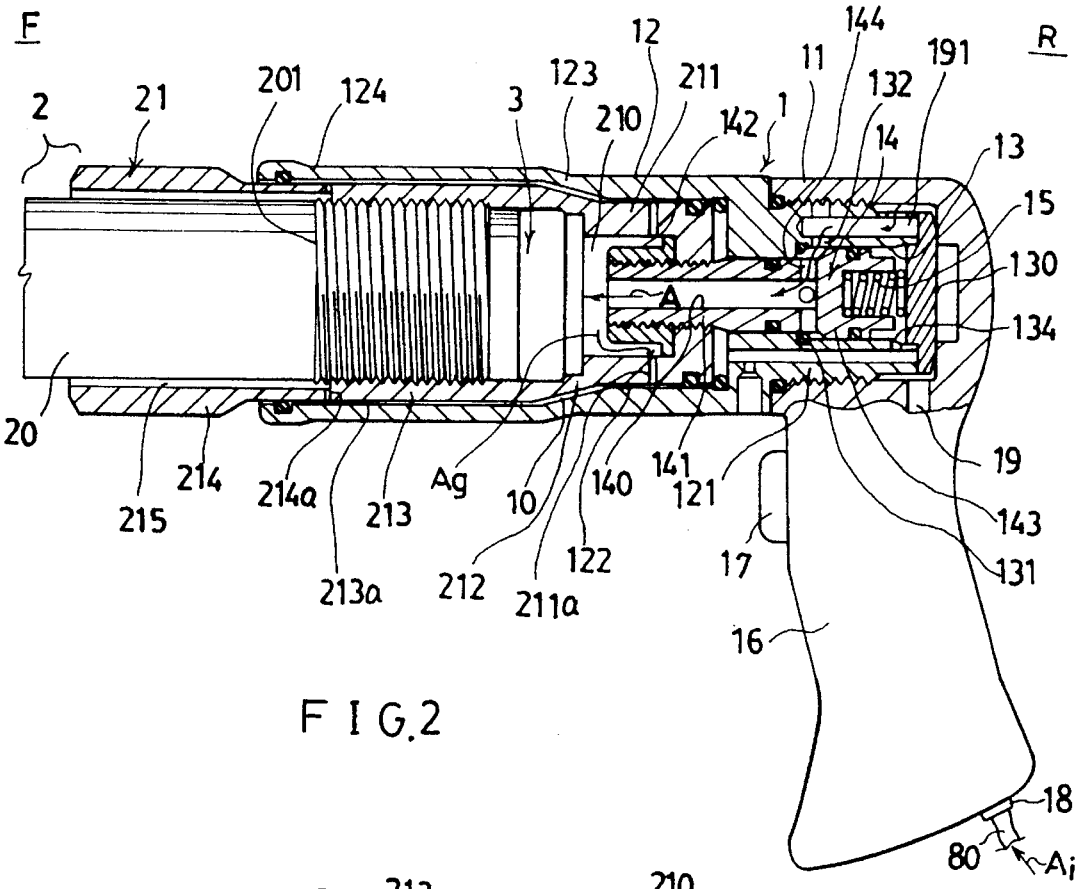
FIG. 2 is a partial sectional drawing showing an opened throttle valve of the present invention.
Figure 3:
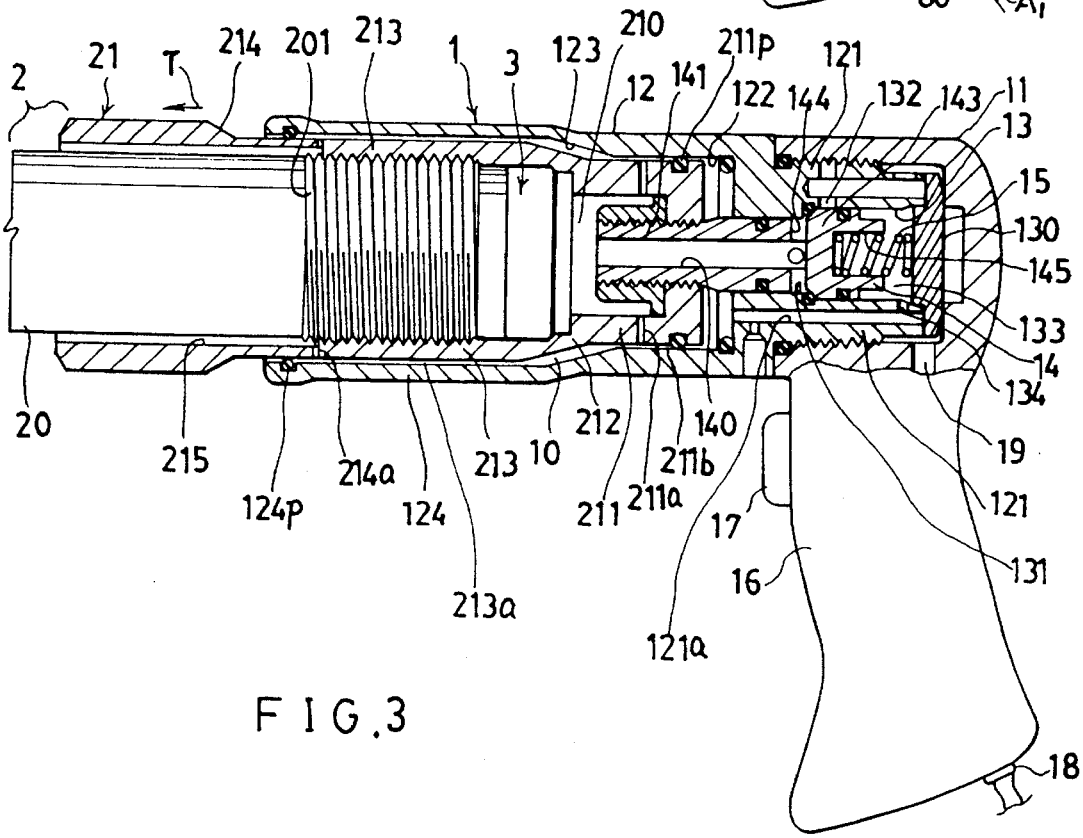
FIG. 3 shows a closed throttle valve in accordance with the present invention.

The main cylinder 1 as shown in FIGS. 1–3 includes: a rear housing portion 11 secured with a grip portion 16 having an operating lever 17 pivotally mounted in the grip portion 16 for controlling on and of of a compressed air supply directed into a main air inlet port 19 of the main cylinder 1 through an inlet air adapter 18 and a main inlet air hose portion 80; a bell member 12 generally cylindrical shaped having a rear connector 121 secured in the rear housing portion 11, a contracted bell portion 122 protruding forwardly from the rear connector 121 to connect a truncated-cone bell portion 123 diverging forwardly from the contracted bell portion 122, and a divergent bell portion 124 secured to the truncated-cone bell portion 123 having an inside diameter of the divergent bell portion 124 larger than that of the contracted bell portion 122; a valve socket 13 of an automatically-closed throttle valve 14 having a rear retainer disk 130 fixed in the rear housing portion 11 for retaining a restoring spring 15 for tensioning the throttle valve 14, a valve seat 131 having packing ring embedded thereon formed in the rear connector 121 of the bell member 12 for seating a valve plug 143 of the throttle valve 14, a valve inlet port 132 formed in a front portion of the valve socket 13 adjacent to a valve opening 144 formed in a valve stem 141 of the throttle valve 14, a spring chamber 133 recessed in a rear portion of the plug 143 for retaining the restoring spring 15 and a venting hole 134 formed in the valve socket 13 and communicating with an air-venting passage 121*a* formed through the rear connector 121 for breathing air in the spring chamber 133 with an outer environment around the main cylinder 1; and the automatically-closed throttle valve 14 having the valve stem 141 defining a central air passage 140 through the valve stem 141 and secured with a rear cap portion 211 of a rear barrel cap 21 of the barrel member 2, with the barrel member 2 and the throttle valve 14 normally restored forwardly by the restoring spring 15 for closing the plug 143 of the throttle valve 14 on the seat 131 of the valve socket 13 for closing the valve opening 144 and the valve inlet port 132 for stopping flow of compressed air A into the barrel member 2 and the oscillating valve 3. The bell member 12 has a front packing ring 124*p* and the rear barrel cap 21 has a rear packing ring 211*p* for defining the cooling-air passages 211*b*, 213*a* and the air-cushion chamber 10 therebetween.

The rear barrel cap 21 of the barrel member 2 includes: the rear cap portion 211 defining a barrel inlet chamber 210 formed inside the rear cap portion 211, the barrel inlet chamber 210 communicating with the oscillating valve 3 and the central air passage 140 of the valve stem 141, a first cooling-air passage 211*b* defined between the rear cap portion 211 and the contracted bell portion 122, an upstream air aperture 211*a* formed in the rear cap portion 211 communicating with the inlet chamber 210 and the first cooling-air passage 211*b*, a truncated-cone barrel portion 212 diverging forwardly from the rear cap portion 211 and defining an air-cushion chamber 10 between the truncated-cone barrel portion 212 and the truncated-cone bell portion 123, an intermediate cap portion 213 secured with a rear end portion of a barrel cylinder 20 of the barrel member 2 and defining a second cooling-air passage 213*a* between the intermediate cap portion 213 and the divergent bell portion 124, a skirt portion 214 secured to the intermediate cap portion 213 which is fixed with a rear end portion of the barrel cylinder 20 of the barrel member 2, and a third cooling-air passage 215 defined between the barrel cylinder 20 and the skirt portion 214 to communicate with the second cooling-air passage 213*a* through a downstream air aperture 214*a* formed in the skirt portion 214 for directing a cooling-air streamflow Ag through the inlet chamber 210, the upstream air aperture 211*a*, the first cooling-air passage 211*b*, the air-cushion chamber 10, the second cooling-air passage 213*a*, the downstream air aperture 214*a* and the third cooling-air passage 215 outwardly to an outer environment (atmosphere) for cooling the barrel member 2 and for dampening the vibration shock of the pneumatic tool.

Figure 4:
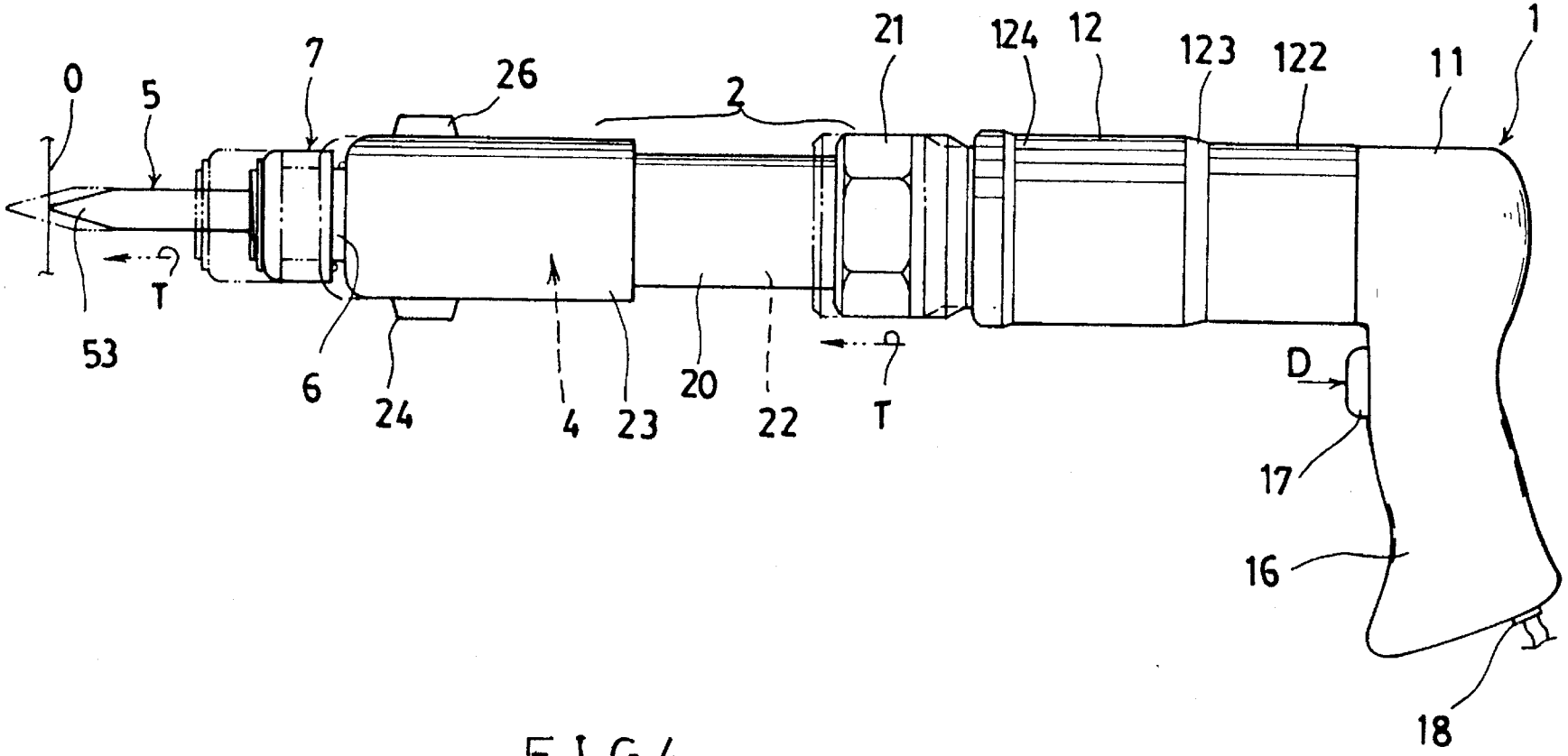
FIG. 4 shows an empty percussion of the tool unit for automatically closing the throttle valve of the present invention.

Upon contacting of the tool unit 5 with a working object O as shown in FIGS. 1, 2 and 4, the tool unit 5 and the barrel member 2 will be rearwardly retracted to push the plug 143 of the throttle valve 14 rearwardly to open the valve opening 144 and the valve inlet port 132 for directing compressed air A through an inlet passage 191 of the main air inlet port 19 in the main cylinder 1 through the central passage 140, the inlet chamber 210 and the oscillating valve 3 for controlling a back-and-forth air flow in the inner compartment 22 in the barrel cylinder 20 for reciprocatively moving the piston means 4 for pounding the tool unit 5 on the working object O, and whereby upon a slipping of the tool unit 5 from the working object O or after piercing through the working object O by the tool unit 5, to be under a no load condition or "empty percussion" situation, the restoring spring 15 will simultaneously restore the plug 143 forwardly to re-close the valve opening 144 to stop compressed air A into the barrel member 2 to stop the reciprocating movement of the piston means 4 for preventing a vibration shock.

The air streamflow Ag from the inlet chamber 210, the upstream aperture 211*a*, the first cooling-air passage 211*b*, the air-cushion chamber 10, the second cooling-air passage 213*a*, the downwstream aperture 214*a*, and the third cooling-air passage 215 will serve as a "general cooling-air passage" for cooling the barrel member 2 during a reciprocative movement of the piston means 4 therein, and the air-cushion chamber 10 will dampen the vibration shock during the operation of the pneumatic tool. The abovementioned "generally cooling-air passage" will also render an "air bearing effect" to linearly straighten on stably guide the reciprocative movement of the barrel member 2 within the main cylinder 1 for a reliable maneuverable and wear preventive pneumatic operation.

Figure 5:
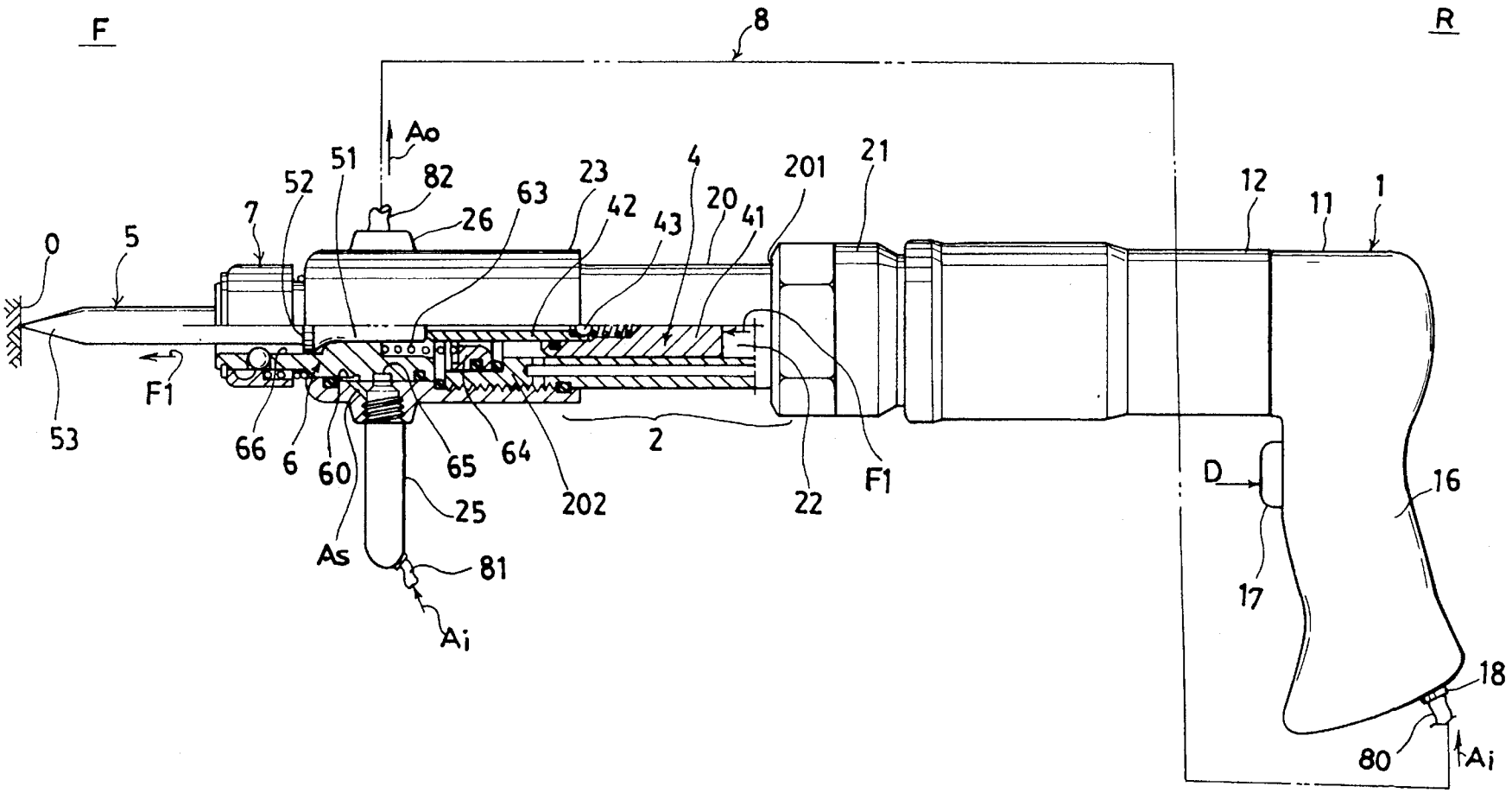
FIG. 5 is an illustration of the present invention having its front portion being partially cut away.
Figure 6:
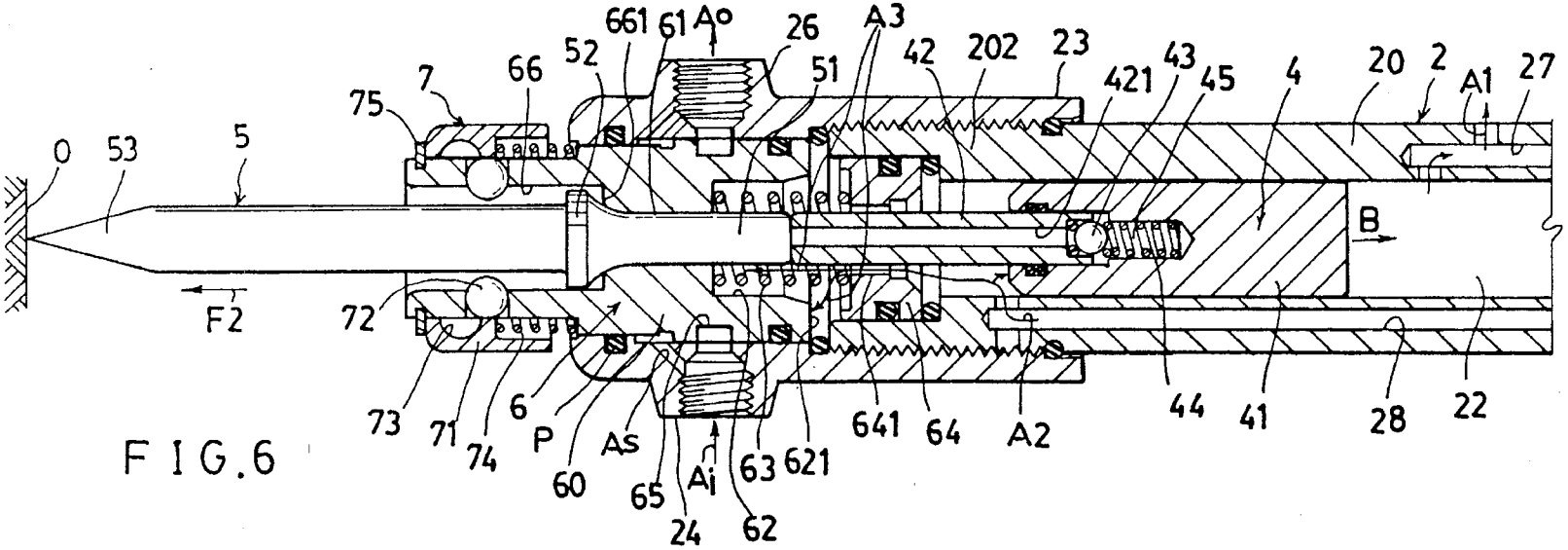
FIG. 6 shows a rearwardly retracted bushing member communicating with an inlet compressed air supply when the tool unit touching a working object in accordance with the present invention as enlarged from FIG. 5.
Figure 7:
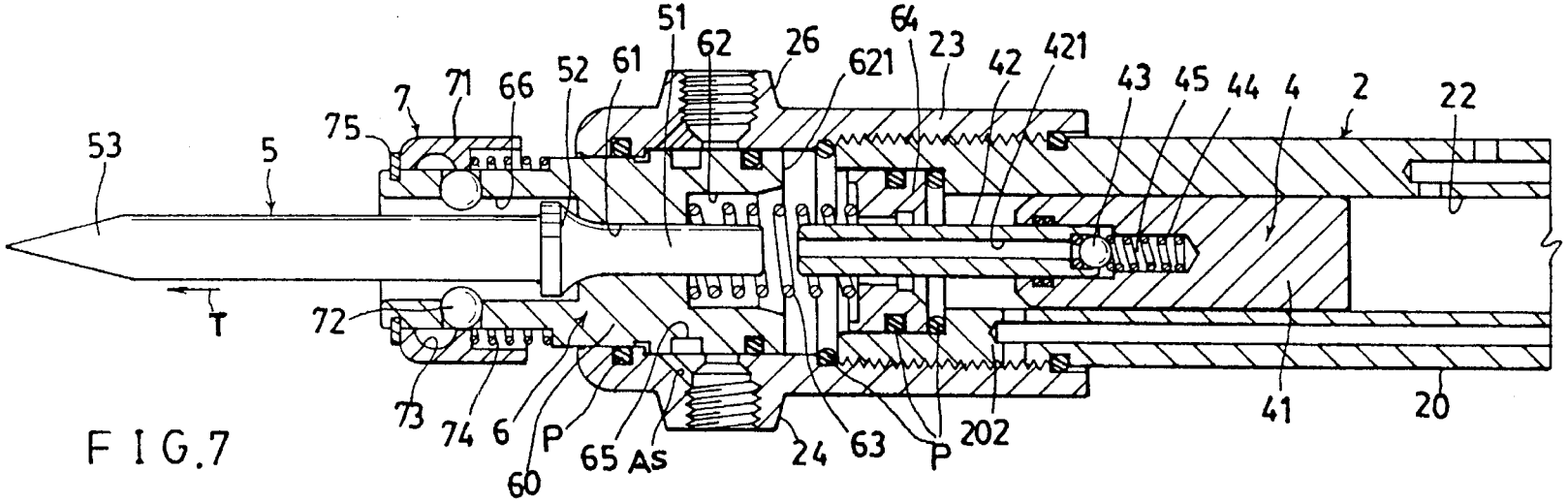
FIG. 7 shows a forwardly protruded bushing member to interrupt the inlet compressed air supply when the tool unit is under no load condition in accordance with the present invention.

Besides, a front portion of the pneumatic tool of the present invention as shown in FIGS. 5–7 may have also the automatic shut-off function under no load condition and shock preventive properties to synchronously cooperate an automatic shut-off and shock absorbing property as formed in a rear portion of the tool as shown in FIGS. 1–3 as abovementioned.

Naturally, either automatic shut-off mechanism as formed in the rear portion of the tool (FIGS. 1–3) or the shut-off mechanism as formed in the front portion of the tool (FIGS. 5–7) as described hereinafter may be used independently to automatically stop the reciprocative pounding operation of the tool in case of "empty percussion" under no load condition for preventing vibration shock for occupational safety and health purpose.

As shown in FIGS. 5–7, the barrel member 2 includes: the rear barrel cap 21 formed on the rear end portion of a barrel cylinder 20 positioned in front of the main cylinder 1, an inner compartment 22 longitudinally formed through the barrel cylinder 20 for reciprocatively holding the piston means 4 in the inner compartment 22, a front barrel cap 23 secured on the front end portion of the barrel cylinder 20 for holding the bushing member 6 of the tool unit 5 in the front barrel cap 23, an inlet air port 24 formed on the first side portion of the front barrel cap 23 for connecting an auxiliary handle 25 (FIGS. 5 and 4) and an input air hose 81 of the compressed air hose 8 for directing compressed air (Ai) into the front portion of the pneumatic tool of this invention, an outlet air port 26 formed on a second side portion of the front barrel cap 23 for directing the compressed air through an output air hose 82 to the inlet-air adapter 18 formed on the grip portion 16 of the main cylinder 1 for directing compressed air in the inner compartment 22 for forwarding the piston means 4 (downstroke, F1) for primarily impacting and pounding the tool unit 5 (FIG. 5), an exhaust air compartment 27 formed in the barrel cylinder 20 and communicating with a middle portion of the inner compartment 22 of the barrel member 2 for discharging exhaust air (A1) outwardly as shown in FIG. 6 when returning the piston means 4 (B) during an upstroke of the piston means 4, and an outer compartment 28 formed in the barrel cylinder 20 and communicating with the front portion of the inner compartment 22 and the bushing member 6 for delivering compressed air (A2) from the oscillating control valve 3 mounted on the rear end portion of the barrel member 2 for returning the piston means 4 (B) during an upstroke of the piston means 4 and also for forwardly thrusting the bushing member 6 and the tool unit 5 (A3) for secondarily forcing and impacting the tool unit 5 (F2) instantly and suddenly upon an initial returning (upstroke, B) of the piston means 4 from its lower deadpoint.

The piston means 4 includes: a plunger portion 41 having a dampening socket 45 recessed rearwardly from a front end surface of the plunger portion 41 for filling a dampening fluid such as hydraulic oil in the dampening socket 45, an impacting rod portion 42 having a rear end of the impacting rod portion 42 coupled with the plunger portion 41 and having a central hole 421 formed through the impacting rod portion 42 for filling the dampening fluid into the dampening socket 45, a sealing ball 43 resiliently sealing the central hole 421 of the impacting rod portion 42 as urged by a tension spring 44 retained in the dampening socket 45 for preventing leakage of the dampening fluid from the dampening socket 45, the rear end of the impacting rod portion 42 resiliently coupled with the plunger portion 41 by the tension spring 44 retained between the impacting rod portion 42 and the plunger portion 41, and a front end of the impacting rod portion 42 forcibly impacting the tool unit 5 during a forth movement of the piston means 4.

The bushing member 6 includes: a sliding block 60 movably mounted in the front barrel cap 23 of the barrel member 2 and having a central tool hole 61 formed through the sliding block 60 for mounting the forcing stem portion 51 of the tool unit 5 in the central tool hole 61, a spring socket 62 recessed forwardly from a rear shoulder portion 621 for retaining the front portion of a bushing restoring spring 63 in the spring socket 62, a rear retainer 64 secured at the front end of the barrel cylinder 20 for retaining a rear end of the bushing restoring spring 63 and having a central air passage 641 formed through the rear retainer 64 for directing a compressed air stream A3 when returning (B) the piston means 4 for forcing the bushing member 6 for pounding the tool unit 5, an annular groove 65 circumferentially recessed in the sliding block 60 to communicate with the inlet air port 24 and the outlet air port 26 diametrically formed on the front barrel cap 23 when the tool unit 5 is contacted with a working object O as shown in FIGS. 6 and 5 for directing compressed air (Ai, Ao) through the inlet and outlet air ports 24, 26 to the inlet-air adapter 18 of the main cylinder 1, and a front recess 66 recessed rearwardly from the front end of the sliding block 60 for movably holding an intermediate convex portion 52 formed in between the forcing stem portion 51 and a pounding rod portion 53, which may be a bit, an acute tip or other tool ends, of the tool unit 5, with the bushing restoring spring 63 normally urging the sliding block 60 of the bushing member 6 forwardly to disengage the annular groove 65 from the inlet and outlet air ports 24, 26 to preclude an entrance of compressed air to interrupt air supply to the main cylinder 1 to stop the pounding of tool unit 5 when the tool unit 5 is slid or separated from working object O as shown in FIG. 7 (T) to also prevent vibrational shock when the tool unit is under no load condition (empty percussion), and upon a touching of the pounding rod portion 53 of the tool unit 5 with the working object O to retract the tool unit 5 to allow the convex portion 52 to push the sliding block 60 rearwardly to engage the annular groove 65 with the inlet air port 24 for directing compressed air into the pneumatic tool for normal pounding operation of the pneumatic tool as shown in FIG. 6.

The tool unit 5 is mounted on the front portion of the pneumatic tool of the present invention by a tool connector 7 which is so conventional and may include: a retaining cylinder 71 resiliently disposed around the front portion of the bushing member 6, at least a limiting ball 72 retained in the retaining cylinder 71 for limiting an outward and forward thrusting movement of the convex portion 52 of the tool unit 5, a tension spring 74 retained between the bushing member 6 and the retaining cylinder 71, a fastener (or retainer) 75 secured in the front end of the connector 7 for limiting the retaining cylinder 71, and a ball socket 73 recessed in the retaining cylinder 71 for receiving the limiting ball 72 when retracting the cylinder 71 to drop the ball 72 into the ball socket 73 for replacing or changing a tool unit 5.

All reciprocative and moving parts may be embedded or jacketed with packing rings or O-ring P for air tightness and leakage prevention.

Upon a rearward movement of the tool unit 5, the bushing member 6 will be pushed rearwardly to compress the spring 63 which will serve as a buffer for dampening partial vibration shock of the tool unit 5, and the forcing stem portion 51 of the tool unit 5 will act on the impacting rod portion 42 to compress the spring 44 within the piston means 4 and to force upon the dampening fluid or oil filled in the dampening socket 45 to absorb the vibration shock by the pounding tool unit 5 for preventing vibrational accidents or hazards.

A cooling air passage As is inclinedly formed in the front cap 23 communicating with the inlet port 24 and an aperture between the sliding block 60 and an inside wall of the front cap 23 for dissipating frictional heat between the bushing member 6 and the cap 23 for a smooth operation of the pneumatic tool of the present invention.

During a normal percussion job by depressing (D) the grip portion 16 of the pneumatic tool forwardly to poke the pounding rod portion 53 of the tool unit 5 onto the working object O, the compressed air A will be directed into the main cylinder 1, the barrel member 2 to boost the piston means 4 forwardly to impact the tool unit 5 for percussing the working object O primarily during the downstroke (F1) of the piston means 4, and just when the piston means 4 is returned during its upstroke (B), the suddenly branched air stream A3 from the outer compartment 28 as controlled by the oscillating valve 3 (which is conventional) will force the shoulder portion 621 of the bushing member 6, as also aided by the restoring spring 63, forwardly to allow the front shoulder portion 661 to impact the convex portion 52 of the tool unit 5 to secondarily pound the tool unit 5 for strengthening a pounding job of the tool unit 5 and also to enforce a closely contacting between the bushing member 6 and the tool unit 5 for preventing frictional wearing or loosening vibration therebetween.

Once the bit or front tip of the tool unit is slipped or "escaped" from the working object O, the restoring spring 63 will restore the bushing member 6 forwardly to disengage the recess 65 from the inlet compressed air to interrupt the piston movement for preventing a vibration shock during the "empty percussion" of the tool unit 5. Simultaneously, the throttle valve 14 and the barrel member 2 will no longer be retracted by the tool unit 5 so that the restoring spring 15 will restore the valve plug 143 to close the opening 144 to automatically close the throttle valve 14 to stop air supply into the inner compartment 22 to stop the piston movement to thereby also prevent vibration shock by the tool unit 5.

Hence, the shock prevention function of the present invention is twofold both at the front portion (FIGS. 5–7) and the rear portion (FIGS. 1–3) of the pneumatic tool to perfectly ensure an automatic shut off of the tool when the working object O is pierced through by the tool unit 5 or when the tool unit 5 is slipped from the working object O under no load condition for occupational safety and health.

I claim:

1. A pneumatic tool comprising:

a main cylinder (1) having a grip portion (16) secured thereto and an operating lever (17) for opening or closing a compressed air into said main cylinder (1);

a barrel member (2) having a rear end thereof resiliently secured to the main cylinder (1);

an automatically closed throttle valve (14) resiliently mounted in said main cylinder (1) by a restoring spring

(15) for closing said throttle valve (14) normally for stopping the supply of a compressed air;

an oscillating valve (3) mounted in a rear portion of said barrel member (2) for controlling the compressed air for reciprocatively moving a piston means (4) in said barrel member (2) for pounding a tool unit (5) secured to a front end portion of said barrel member (2) by a tool connector (7);

said barrel member (2) operatively opening said automatically closed throttle valve (14) when said tool unit (5) is contacted with a working object to retract said tool unit (5) and said barrel member (2) for directing the compressed air into said barrel member (2) as controlled by said oscillating valve (3) for reciprocating said piston means (4) for pounding said tool unit (5) on said working object, and whereby upon an empty percussion of said tool unit (5) under no load condition, said barrel member (2) will not be retracted by the working object and said throttle valve (14) will be forwardly restored and closed for interrupting the compressed air for stopping the pounding of said tool unit (5) for preventing vibration shock caused by said tool unit (5); and said main cylinder (1) including: a rear housing portion (11) secured with said grip portion (16) having said operating lever (17) pivotally mounted in the grip portion (16) for controlling on and off of a compressed air supply directed into a main air inlet port (19) of the main cylinder (1) through an inlet air adapter (18) and a main inlet air hose portion (80); a bell member (12) generally cylindrical shaped having a rear connector (121) secured in the rear housing portion (11), a contracted bell portion (122) protruding forwardly from the rear connector (121) to connect a truncated-cone bell portion (123) diverging forwardly from the contracted bell portion (122), and a divergent bell portion (124) secured to the truncated-cone bell portion (123) having an inside diameter of the divergent bell portion (124) larger than that of the contracted bell portion (122); a valve socket (13) of said automatically-closed throttle valve (14) having a rear retainer disk (130) fixed in the rear housing portion (11) for retaining said restoring spring (15) for tensioning the throttle valve (14), a valve seat (131) having packing ring embedded thereon formed in the rear connector (121) of the bell member (12) for seating a valve plug (143) of the throttle valve (14), a valve inlet port (132) formed in a front portion of the valve socket (13) adjacent to a valve opening (144) formed in a valve stem (141) of the throttle valve (14), a spring chamber (133) recessed in a rear portion of the plug (143) for retaining the restoring spring (15) and a venting hole (134) formed in the valve socket (13) and communicating with an air-venting passage (121*a*) formed through the rear connector (121) for breathing air in the spring chamber (133) with an outer environment around the main cylinder (1); and the automatically-closed throttle valve (14) having the valve stem (141) defining central air passage (140) through the valve stem (141) and secured with a rear cap portion (211) of a rear barrel cap (21) of the barrel member (2), with the barrel member (2) and the throttle valve (14) normally restored forwardly by the restoring spring (15) for closing the plug (143) of the throttle valve (14) on the seat (131) of the valve socket (13) for closing the valve opening (144) and the valve inlet port (132) for stopping flow of compressed air into the barrel member (2) and the oscillating valve (3).

2. A pneumatic tool according to claim 1, wherein said rear barrel cap (21) of the barrel member (2) includes: the rear cap portion (211) defining a barrel inlet chamber (210) formed inside the rear cap portion (211), the barrel inlet chamber (210) communicating with the oscillating valve (3) and the central air passage (140) of the valve stem (141), a first cooling-air passage (211*b*) defined between the rear cap portion (211) and the contracted bell portion (122), an upstream air aperture (211*a*) formed in the rear cap portion (211) communicating with the inlet chamber (210) and the first cooling-air passage (211*b*), a truncated-cone barrel portion (212) diverging forwardly from the rear cap portion (211) and defining an air-cushion chamber (10) between the truncated-cone barrel portion (212) and the truncated-cone bell portion (123), an intermediate cap portion (213) secured with a rear end portion of a barrel cylinder (20) of said barrel member (2) and defining a second cooling-air passage (213*a*) between the intermediate cap portion (213) and the divergent bell portion (124), a skirt portion (214) secured to the intermediate cap portion (213), and a third cooling-air passage (215) defined between the barrel cylinder (20) and the skirt portion (214) to communicate with the second cooling-air passage (213*a*) through a downstream air aperture (214*a*) formed in the skirt portion (214) for directing a cooling-air streamflow through the inlet chamber (210), the upstream air aperture (211*a*), the first cooling-air passage (211*b*), the air-cushion chamber (10), the second cooling-air passage (213*a*), the downstream air aperture (214*a*) and the third cooling-air passage (215) outwardly to the atmosphere for cooling the barrel member (2) and for dampening the vibration shock of the pneumatic tool; whereby upon contacting of the tool unit (5) with a working object, the tool unit and the barrel member will be rearwardly retracted to push the plug of the throttle valve rearwardly to open the valve opening and the valve inlet port for directing compressed air through the main air inlet port (19) in the main cylinder (1) through the central passage (140), the inlet chamber (210) and the oscillating valve (3) for controlling a back-and-forth air flow in an inner compartment (22) in the barrel cylinder (20) for reciprocatively moving the piston means (4) for pounding the tool unit (5) on the working object (O), and whereby upon a slipping of the tool unit (5) from the working object to have a no load condition, the restoring spring (15) will restore the plug (143) forwardly to re-close the valve opening (144) to stop compressed air into the barrel member (2) to stop the reciprocating movement of the piston means (4) for preventing a vibration shock.

3. A pneumatic tool according to claim 2, wherein said barrel member (2) includes: the rear barrel cap (21) secured to a rear end portion of the barrel cylinder (20) positioned in front of the main cylinder (1), a front barrel cap (23) secured on a front end portion of the barrel cylinder (20) for holding a bushing member (6) disposed around the tool unit (5) in the front barrel cap (23), an inlet air port (24) formed on a first side portion of the front barrel cap (23) for connecting an auxiliary handle (25) and an input air hose portion (81) of the compressed air hose (8) for directing compressed air into the bushing member (16), an outlet air port (26) formed on a second side portion of the front barrel cap (23) opposite to said inlet air port (24) for outputing the compressed air through an output air hose portion (82) to an inlet-air adapter (18) formed on a grip portion (16) of the main cylinder (1) for directing compressed air in the inner compartment (22) for forwarding the piston means (4) for primarily impacting and pounding the tool unit (5), an exhaust air compartment (27) formed in the barrel cylinder (20) and communicating with a middle portion of the inner compartment (22) of the barrel member (2) for discharging exhaust air when returning the piston means (4) during an upstroke of the piston means (4), and an outer compartment (28) formed in the barrel cylinder (20) and communicating with a front portion of the inner compartment (22) and the bushing member (6) for delivering compressed air from the oscillating valve (3) mounted on a rear end portion of the barrel member (2) for returning the piston means (4) during an upstroke of the piston means (4) for forwardly thrusting the bushing member (6) and the tool unit (5) for secondarily forcing and impacting the tool unit (5) instantly and suddenly upon an initial returning or upstroke of the piston means (4).

4. A pneumatic tool according to claim 3, wherein said piston means (4) includes: a plunger portion (41) having a dampening socket (45) recessed rearwardly from a front end surface of the plunger portion (41) for filling a dampening fluid in the dampening socket (45), an impacting rod portion (42) having a rear end of the impacting rod portion (42) coupled with the plunger portion (41) and having a central hole (421) formed through the impacting rod portion (42) for filling the dampening fluid into the dampening socket (45), a sealing ball (43) resiliently sealing the central hole (421) of the impacting rod portion (42) as urged by a tension spring (44) retained in the dampening socket (45) for preventing leakage of the dampening fluid from the dampening socket (45), a rear end of the impacting rod portion (42) resiliently coupled with the plunger portion (41) by the tension spring (44) retained between the impacting rod portion (42) and the plunger portion (41), and a front end of the impacting rod portion (42) forcibly impacting the tool unit (5) during a forth moving of the piston means (4).

5. A pneumatic tool according to claim 3, wherein said bushing member (6) includes: a sliding block (60) movably mounted in the front barrel cap (23) of the barrel member (2) and having a central tool hole (61) formed through the sliding block (60) for mounting a forcing stem portion (51) of the tool unit (5) in the central tool hole (61), a spring socket (62) recessed forwardly from a rear shoulder portion (621) for retaining a front portion of a bushing restoring spring (63) in the spring socket (62), a rear retainer (64) secured at a front end of the barrel cylinder (20) for retaining a rear end of the bushing restoring spring (63) and having a central air passage (641) formed through the rear retainer (64) for directing a compressed air stream when returning the piston means (4) for forcing the bushing member (6) for pounding the tool unit (5), an annular groove (65) circumferentially recessed in the sliding block (60) to communicate with the inlet air port (24) and the outlet air port (26) diametrically formed on the front barrel cap (23) when the tool unit (5) is contacted with a working object for directing compressed air through the inlet and outlet air ports to the inlet-air adapter of the main cylinder, and a front recess (66) recessed rearwardly from a front end of the sliding block (60) for movably holding an intermediate convex portion (52) formed in between the forcing stem portion (51) and a pounding rod portion (53) of the tool unit (5), with the bushing restoring spring (63) normally urging the sliding block (60) of the bushing member (6) forwardly to disengage the annular groove (65) from the inlet and outlet air ports (24, 26) to preclude an entrance of compressed air to interrupt air supply to the main cylinder (1) to stop the pounding of tool unit (5) when the tool unit (5) is slid or separated from said working object to prevent vibrational shock when the tool unit is under no load condition, and upon contacting of the pounding rod portion (53) of the tool unit (5) with the working object to retract the tool unit (5) to allow the convex portion (52) to push the sliding block (60) rearwardly to engage the annular groove (65) with the inlet air port (24) for directing compressed air into the pneumatic tool for normal pounding operation of the tool unit (5).

* * * * *